US005535610A

United States Patent [19]

Noé et al.

[11] Patent Number: 5,535,610

[45] Date of Patent: Jul. 16, 1996

[54] METHOD AND APPARATUS FOR ELIMINATING CROSSBOW IN METAL STRIP

[75] Inventors: Rolf Noé; Andreas Noé, both of Mülheim, Germany

[73] Assignee: BWG Bergwerk-Und Walzwerk-Maschinenbau GmbH, Duisburg, Germany

[21] Appl. No.: 261,066

[22] Filed: Jun. 16, 1994

[30] Foreign Application Priority Data

Jul. 13, 1993 [DE] Germany ..... 43 23 385.6

[51] Int. Cl.[6] ..... B21D 1/06

[52] U.S. Cl. ..... 72/8.6; 72/129; 72/160; 72/205

[58] Field of Search ..... 72/205, 160, 161, 72/129, 9

[56] References Cited

U.S. PATENT DOCUMENTS

| | | | |
|---|---|---|---|
| 3,171,464 | 3/1965 | Holtz | 72/160 |
| 3,839,888 | 10/1974 | Greenberger | 72/205 |
| 4,457,149 | 7/1984 | Weinzinger | 72/161 |
| 4,593,549 | 6/1986 | Moriya | 72/160 |

FOREIGN PATENT DOCUMENTS

| | | | |
|---|---|---|---|
| 162517 | 6/1989 | Japan | 72/161 |
| 138821 | 5/1992 | Japan | 72/160 |

*Primary Examiner*—Daniel C. Crane
*Attorney, Agent, or Firm*—Herbert Dubno

[57] ABSTRACT

The cross bowing in metal strip, especially thin metal strip of a thickness less than 2 mm, is removed by providing downstream of the high tensioned section of the strip at which stretch leveling or stretch bend leveling is effected at least one correcting roller which has an adjustable depth of penetration into the path of the strip at a low tension section, the depth of penetration being controlled by measuring the cross bowing also in the low tension section.

14 Claims, 4 Drawing Sheets

METHOD AND APPARATUS FOR ELIMINATING CROSSBOW IN METAL STRIP

FIELD OF THE INVENTION

The present invention relates to a method of eliminating cross bowing from metal strip, especially thin metal strip having a thickness up to 2.0 mm, and, specifically steel strip passed continuously along a processing line. The invention also relates to an apparatus for carrying out the method or to a method of operating such an apparatus. More particularly this invention relates to the elimination of transverse curvature (hereinafter referred to as cross bowing) in thin metal strip in conjunction with the continuous leveling of the strip in a strip processing line involving stretch-bend leveling, bend leveling (roller leveling) and/or stretch leveling.

BACKGROUND OF THE INVENTION

In strip processing lines heretofore, the undesired curvature in the strip has been removed by leveling mechanisms of stretches of these lines in which the strip is brought to a relatively high degree of tension between sets of rollers which frictionally engage the strip, generally upstream and downstream bridles. The upstream bridle is, in effect, a braking set of rollers which retards advance of the strip while the downstream bridle is a set of driven rollers which draws the strip along the path. The conjoint action of the upstream and downstream bridles provides a tension along the path which can eliminate to a certain extent longitudinal curvature by stretch leveling. Between the bridles, a reverse bending set of rollers may be provided to effect stretch-bend leveling. In the strip processing field simple bend leveling or roller leveling may also be used, the strip being bent by rollers which penetrate into the path of the strip.

The curvatures which are removed in the leveling operation may include transverse curvature (cross bowing) and residual longitudinal curvature which is noticeable in sheets cut from the strip and is referred to generally as coil set since that longitudinal curvature tends to be associated with the curvature which remains in the strip after it is unwound from a coil. Both the coil set and the cross bowing can give rise to problems in the processing of the strip in the strip processing line or in fabrication lines to which the strip may be fed for production of products from the metal strip.

To avoid these problems, it is known to reduce the cross bowing in association with stretch bend leveling by adjusting the depth of penetration of stretch bending rolls, thereby compensating for the cross bowing by adjusting the penetration depth of a stretch bending roller. Here, however, the attempt at correction is applied to the strip at a region of maximum tension, i.e. the tension at which the stretch bend leveling occurs.

The strip then passes into a section of the line at which the tension is reduced, i.e. a section beyond the last tension roller or the downstream bridle where the cross bowing is measured by sensors to produce the setting signal for adjusting the penetration depth of the adjustable roller of the stretch bend leveler (see U.S. Pat. No. 4,457,149).

It has been found, with this process that surface defects can result, especially in very thin strip or strip which is sensitive to the formation of surface defects utilizing this approach. In addition, there appears to be a nonuniform effect over the width of the strip so that adjustment of the stretch bending roller does not give rise to uniform elimination of the cross bowing across the width of the strip. This has been found to be a consequence of the multiaxial stresses applied at the high tensions to which the strip may be subject in the stretching section of the path. Furthermore, there is a reduction of width because of the stretch phenomenon over this high tension region.

It is especially disadvantageous with this earlier system that a dead zone or response lag exists between the measurement and correction in this earlier system which makes it impossible to totally eliminate cross bowing and is due to fluctuations in the strip tension, fluctuations in the strip thickness, variations in the elastic limit or yield point or tensile strength of the strip.

As a consequence, segments of the strip can arise which have unsatisfactory levels of cross bowing and which must be cut out of the strip as reject portions. This is costly to production and expensive to carry out.

It is also known to provide strip processing lines which include stretch leveling portions and in which the cross bowing following the stretch leveling is effected over a section of the strip processing line with substantially reduced strip tension by comparison with that which prevails in the stretch leveling section. The cross bowing is here eliminated by a roller bending operation with correcting rollers which have fixed diameter, fixed contact angles with the strip and hence fixed penetration into the path of the strip. The drawback with this system is that the system is sensitive to the choice of the roll diameters, the contact angles of the strip around the periphery of the correcting rollers and the like and these values are not optimal for all metal strip and require selection based upon such parameters as strip tension, strip thickness and strip tensile strength. The setup of the apparatus is time consuming and generally the apparatus cannot readily be reset to take into consideration these parameters except at very high cost and in a time consuming matter.

OBJECTS OF THE INVENTION

It is therefore an object of the present invention to provide an improved method of operating a strip processing line for metal strip, especially steel strip of a maximum thickness of say 2 mm, i.e. relatively thin metal strip, whereby the drawbacks of earlier techniques are obviated.

Another object is this invention is to provide a process for eliminating or reducing cross bowing in thin metal strip which can be used for metal strip of different thicknesses and operating parameters, whereby the cross bowing is eliminated without dead stretches or response lags and whereby the entire operation is simpler, more economical and more reliable than earlier systems.

It is also an object of the invention to provide an improved apparatus or strip processing line whereby drawbacks of earlier lines are eliminated.

SUMMARY OF THE INVENTION

These objects and others which will become apparent hereinafter are attained in accordance with the invention in a process for processing metal strip which utilizes, in a low tension region of the line downstream of the high tension region at which a stretch leveling or stretch bend leveling occurs, a further leveling utilizing a roller leveler, but having a correction roller whose depth of penetration into the path of the strip (defection of the strip to either side of the neutral line of the strip or its travel plane) is adjusted or varied in response to the cross bowing measured in this downstream region of roller tension.

It will be immediately apparent that as a consequence of the approach of having an adjustable correction roller whose penetration depth can be varied, dead stretches and response lags can be practically completely eliminated. Furthermore, the correction roller can uniformly eliminate the cross bowing across the entire width of the strip because the cross bowing is eliminated by a roller leveling with the adjustable roller downstream of the high tension section.

Furthermore, since the cross bowing is most noticeable in the region in which the tension is reduced, the response to measurement of the cross bowing and hence the possibility that the cross bowing can be eliminated completely is improved. Measurement is facilitated and correction can be effected of cross bowing independently of the instantaneous thickness of the strip, the yield point or tensile strength.

A method of operating a strip processing line according to the invention can then comprise:

(a) subjecting metal strip in a strip processing line to at least one leveling stage selected from stretch-bend leveling and stretch leveling at a certain strip tension;

(b) thereafter passing the metal strip through a section of the line at a tension less than the certain strip tension; and (c) along the section subjecting the strip to roller leveling with at least one adjustable penetration depth correcting roller having a penetration depth varied in accordance with a tendency to cross bowing formation.

The stretch bending line or apparatus for which the method of the invention is particularly suited, can comprise:

means for measuring cross bowing in the strip downstream of a final tensioning roller for leveling of the strip with the certain tension to produce an actual value signal;

means for generating a setting signal from the actual value signal; and means for controlling the penetration depth with the setting signal.

This apparatus has a drawing roller set and a braking roll set establishing the stretch leveling segment of the path of the strip and a stretch bending pair of rollers can be located between these bridles. In the strip travel direction downstream of the tension roller, the transverse curvature or cross bowing of the strip is detected by a measuring device. Downstream of the last tension roller or drawing bridle, moreover, the correcting roller is provided and is mounted to penetrate into the path of the strip to a predetermined degree to eliminate cross bowing in response to a setting signal product by the control device in response to the measurement of cross bowing.

The correcting roller is thereby caused to penetrate more or less deeply into the path of the metal strip travelling therepast so that the cross bowing is eliminated with precision.

The correcting rollers can be located upstream of the measuring device in a preferred embodiment of the invention although it is possible to locate measuring device upstream of the roll as desired.

Correcting rollers can be on opposite sides of the travelling measuring strip to provide positive and negative correction of the cross bowing as may be required. In such cases, as well as in other cases, the correcting rollers can be located between two guide rollers which simultaneously provide supporting functions for the metal strip. The cross bowing is best corrected upstream of any trimming operation with a-trimming shear downstream of the correcting roller so that the width tolerances of the strip can be maintained following the trimming operation.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
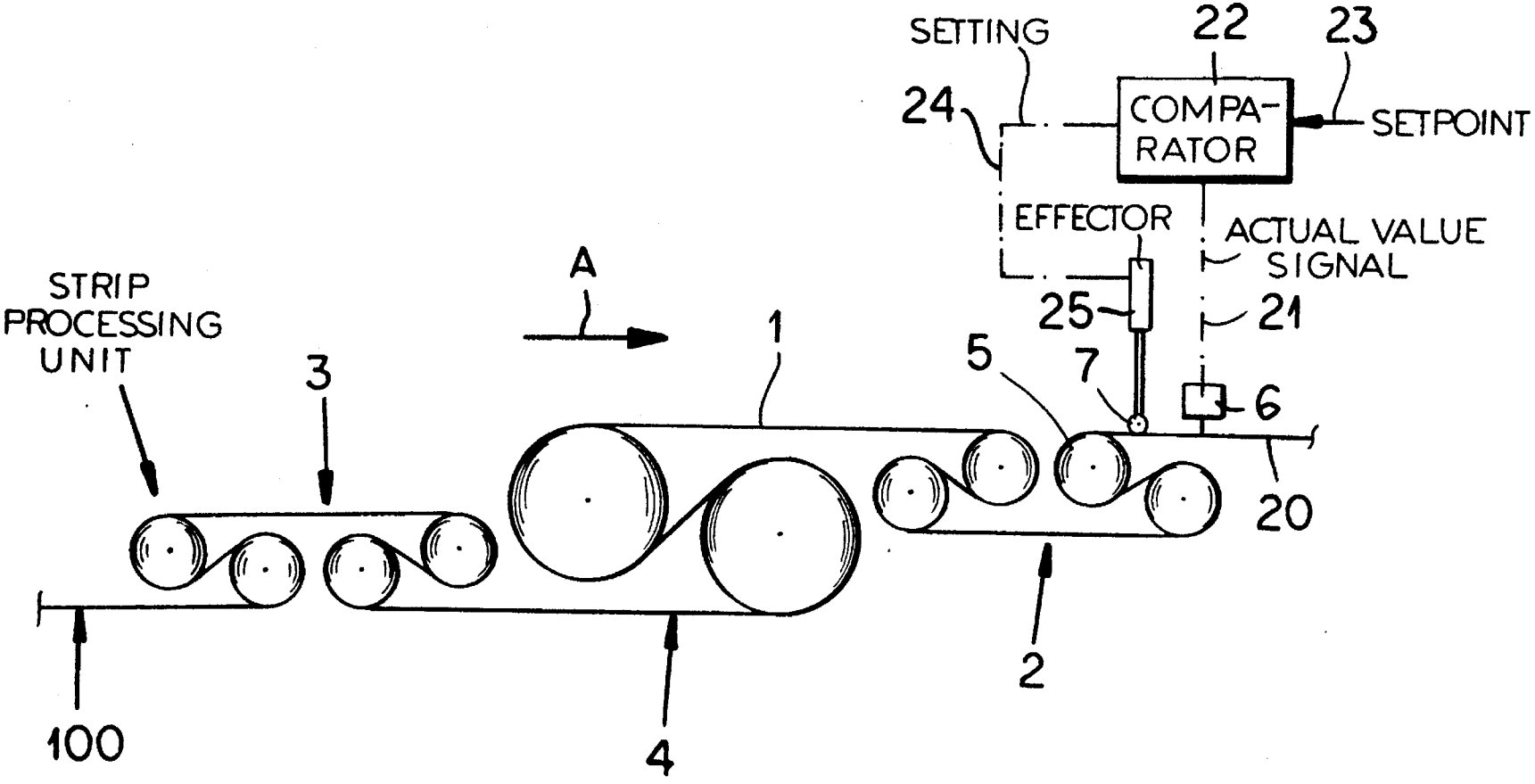
FIG. 1 is a diagrammatic side elevational view of a portion of a strip processing line according to the invention wherein a stretch bend leveler is provided within the stretch leveling section.

In the drawing we have shown a stretch leveling apparatus for metal strip 1 adapted, according to the invention, to eliminate the transverse curvature or cross bowing in the metal strip. The portion of the strip processing line 100 upstream of this portion of the apparatus has not been shown but can include a section in which the strip is drawn from a coil with some degree of coil set, any strip processing uniform which maybe necessary and other leveling stages if desired. The stretch leveling portion of the stage shown comprises an upstream roller set or bridle 3 in which the rollers are braked and referred to herein as a braking roller set, and a driven roller set or bridle 2 applying the tension to the strip 1 between these roller sets. If the tension is sufficient to reduce the coil set, the two bridles together form the stretch leveling means. If desired, however, a stretch bend leveler 4 can be provided along this high tension portion of the line to reduce the coil set.

In the strip travel direction (arrow A) downstream of the last tension roller 5 of the bridle 2, a measuring device 6 is provided to detect the transverse curvature or cross bowing of the strip 1. The sensor or measuring device for detecting the device has been described in the aforementioned U.S. Patent.

Figure 4:
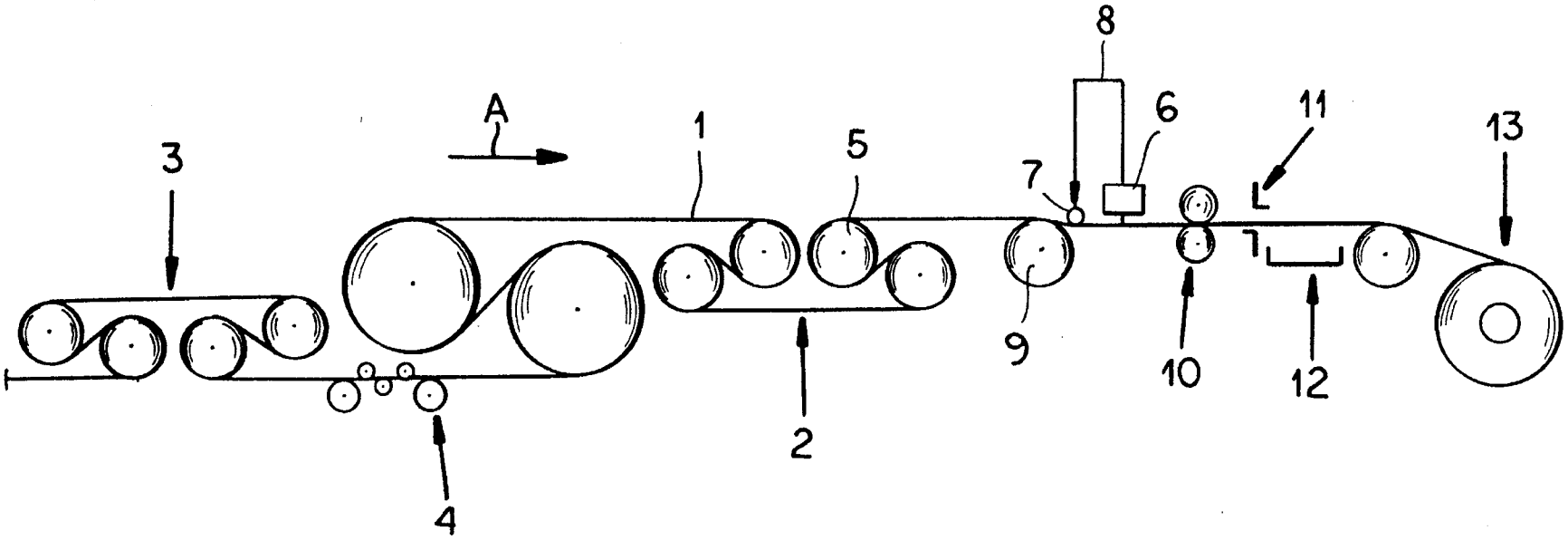
FIG. 4 is a view similar to FIG. 1 but with a modification thereof as to the location of the correcting roller and its relationship to a shear for cutting defective segments from the strip and an inspection stretch or zone of the strip path.

Also downstream of the last tension roller 1, over a stretch 20 of the line 100 with reduced tension, i.e. a tension less than that provided in the stretch between the bridles 2 and 3, a roller leveling system can be provided which includes at least one adjustable correcting roller 7 which can have, as shown at 8 in FIG. 4, a feedback control circuit or the like to regulate the depth of penetration of the correcting roller 7 into the path of the strip.

Figure 2:
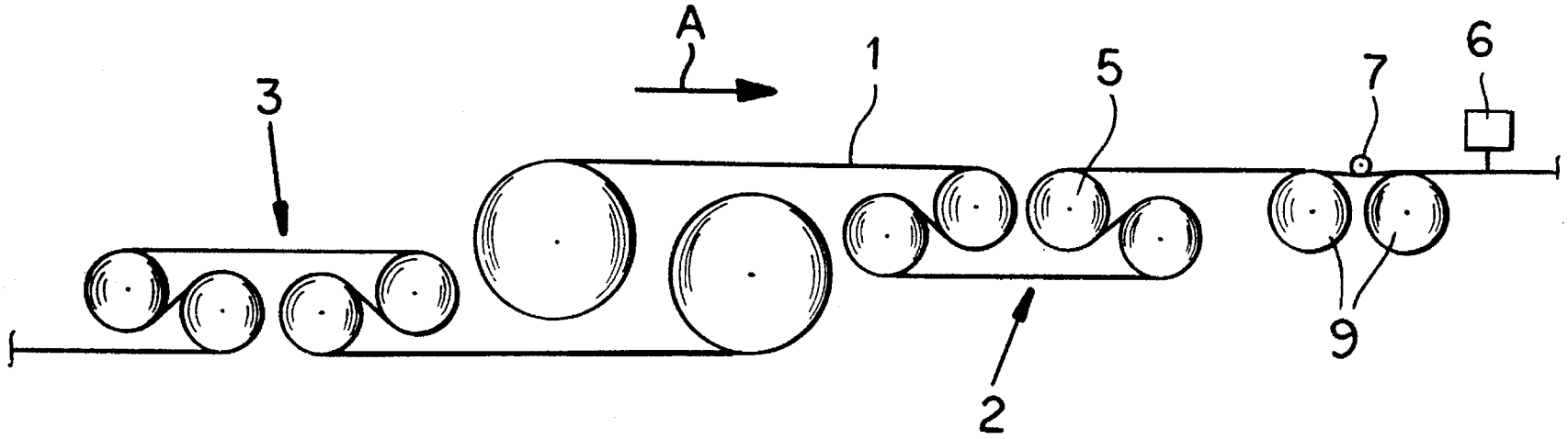
FIG. 2 is a view similar to FIG. 1 wherein a correcting roller is provided between two supporting rollers.
Figure 3:
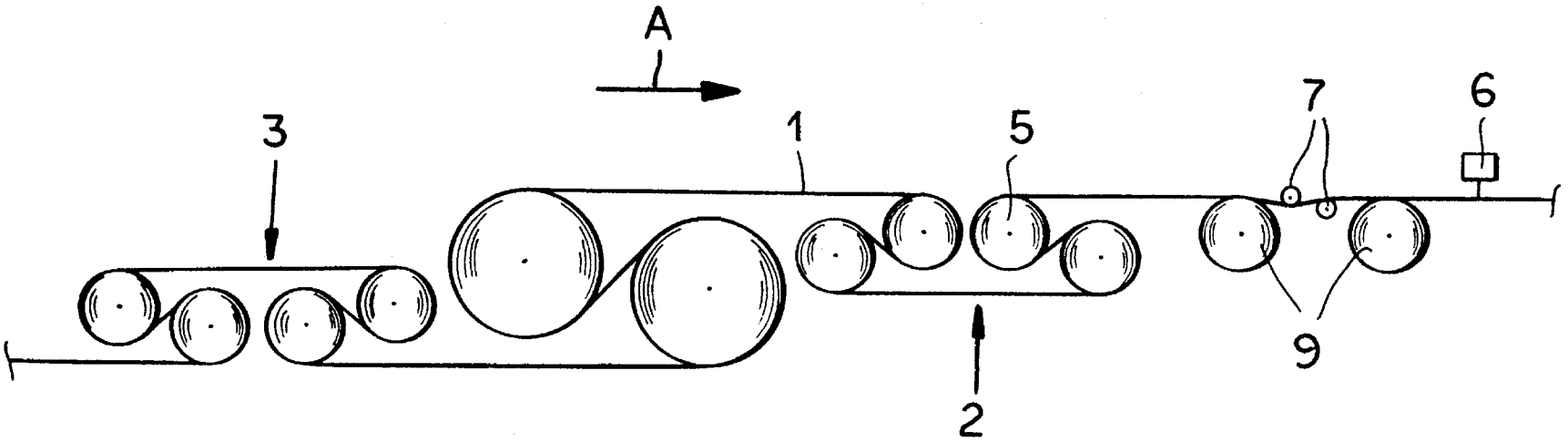
FIG. 3 is a view similar to FIG. 2 showing a correcting roller on the opposite side of FIG. 1 as well.

For example, the actual value signal 21 from the cross bowing measuring unit 6 can be applied to a comparator 22 which is fed with a setpoint or desired value signal 23 selected to nullify the cross bowing. The difference, i.e. the error or setting signal 24 is applied to an effector 25 such as a hydraulic cylinder controlling the position of the roller 7. The depth of penetration is thus adjusted until the transverse curvature or cross bowing is eliminated. As can be seen from FIG. 2, the correcting roller 7 can be located between two supporting rollers 9. In FIG. 3, two correcting rollers 7 can engage the strip 1 from opposite sides between the supporting rollers 9. In both FIGS. 2 and 3, the correcting rollers 7 are displaced by appropriate effectors receiving control signals from the comparator.

In FIG. 4, downstream of the correcting roller 7 and the measuring unit 6 which, in turn, are downstream of a supporting roller 9, a driving pair of rollers 10 is provided to maintain the travel of the strip without applying substantial tension thereto, through a shear 11 which allows segments of the strip to be cutout for inspection at an inspection station 12 so that the quality of the strip can be determined. A welding device can attach ends of the strip thus formed together one another upstream of a coiler 13 to which the strip can be fed.

We claim:

1. A method of operating a strip processing line to eliminate transverse bending in thin metal strip with a thickness up to 2.0 mm, said method comprising the steps of:

(a) subjecting metal strip with a thickness up to 2.0 mm, in a strip processing line between two bridles to at least one leveling stage selected from stretch-bend leveling and stretch leveling at a certain strip tension;

(b) thereafter passing said metal strip through a section of said line at a tension less than said certain strip tension downstream of a last of said bridles; and (c) along said section downstream of said last of said bridles and while said strip is at said tension less than said certain strip tension subjecting said strip to roller leveling with a single individually adjustable penetration depth correcting roller having a penetration depth equal to penetration of said correcting roller into a straight line path of the strip varied in accordance with a tendency to cross bowing formation measured downstream of said last of said bridles.

2. The method defined in claim 1, further comprising the steps of:

measuring cross bowing in said strip downstream of a final tensioning roller for leveling of said strip with said certain tension to produce an actual value signal;

generating a setting signal from said actual value signal; and controlling said penetration depth with said setting signal.

3. A strip processing line, comprising:

an upstream set of rollers engaging a metal strip with a thickness up to 2.0 mm, for braking advance of said metal strip along said strip processing line to brake said strip and initiate a section of said line subjecting said strip to at least one of stretch-bend leveling and stretch leveling at a certain strip tension;

a downstream set of rollers engaging said strip at an end of said section to apply said certain strip tension to said strip; and a roller leveler along said line downstream of said section and said downstream set of rollers and along a section of said line wherein said strip is at a tension less than said certain tension, said roller leveler having a correcting roller individually adjustable as to penetration depth and having a penetration depth equal to penetration of said correcting roller into a straight line path of the strip varied in accordance with a tendency to cross bowing formation measured downstream of said downstream set of rollers.

4. The strip processing line defined in claim 3, further comprising:

means for measuring cross bowing in said strip downstream of a final tensioning roller for leveling of said strip with said certain tension to produce an actual value signal;

means for generating a setting signal from said actual value signal; and means for controlling said penetration depth with said setting signal.

5. The strip processing line defined in claim 4 wherein said means for measuring is located downstream of said correcting roller.

6. The strip processing line defined in claim 5 wherein said roller leveler includes respective correcting rollers on opposite sides of said strip penetrating to respective depths into a path of said strip.

7. The strip processing line defined in claim 6 wherein at least one of said correcting rollers is disposed between a pair of guide rollers supporting said strip.

8. The strip processing line defined in claim 4 wherein said roller leveler includes respective correcting rollers on opposite sides of said strip penetrating to respective depths into a path of said strip.

9. The strip processing line defined in claim 8 wherein at least one of said correcting rollers is disposed between a pair of guide rollers supporting said strip.

10. The strip processing line defined in claim 4 wherein at least one of said correcting rollers is disposed between a pair of guide rollers supporting said strip.

11. In a method of processing metal strip with a thickness up to 2.0 mm, wherein the strip is subjected to at least one stretch bend leveling or stretch leveling stage at a high strip tension, the improvement which comprises the steps of:

a) reducing the tension in said strip while continuing to displace said strip along a strip path;

b) measuring cross bowing in said strip at the reduced tension; and c) controlling depth of penetration of a correcting roller into said path and against said strip to substantially eliminate cross bowing in the strip at said reduced tension.

12. The improvement defined in claim 11 wherein said correcting roller is placed against said .strip while said strip is supported on a pair of supporting rollers.

13. The improvement defined in claim 11 wherein respective correcting rollers are placed against said strip from opposite sides to respective depths determined by measurement of cross bowing of said strip.

14. The improvement defined in claim 11, further comprising the step of cutting sections out of said strip downstream of the correcting roller at measurement of the cross bowing for inspection of the quality of said strip.

* * * * *